United States Patent [19]

Collins

[11] 4,250,509

[45] Feb. 10, 1981

[54] CIRCULARLY POLARIZED ZIGZAG ANTENNA

[75] Inventor: Gerald W. Collins, Quincy, Ill.

[73] Assignee: Harris Corporation, Melbourne, Fla.

[21] Appl. No.: 70,685

[22] Filed: Aug. 29, 1979

[51] Int. Cl.[3] ..... H01Q 1/36

[52] U.S. Cl. ..... 343/806; 343/818

[58] Field of Search ..... 343/806, 818, 819, 890, 343/891, 908

[56] References Cited

U.S. PATENT DOCUMENTS

| | | | |
|---|---|---|---|
| 4,031,537 | 6/1977 | Alford | 343/801 |
| 4,160,978 | 7/1979 | Du Hamel | 343/806 |

*Primary Examiner*—Eli Lieberman

[57] ABSTRACT

A zigzag antenna for broadcasting circularly polarized electromagnetic energy at a mean wavelength L. The zigzag antenna includes a zigzag shaped radiating element (10, 12) composed of plural essentially linear segments (20). These segments, each L/4 in length, are disposed end-to-end with each segment being at right angles to adjacent segments. L/2 non-radiating delay lines (22) are interposed between adjacent segments at alternate junctions between the segments, with the segments being directly joined at the remaining junctions. When fed with electromagnetic energy, the element will broadcast circularly polarized waves since each pair of adjacent segments are orthogonal in space and phase. In the described antenna embodiment, two radiators (10, 12) are arranged above a reflecting panel (16), and are fed from a central feed point (14).

10 Claims, 3 Drawing Figures

CIRCULARLY POLARIZED ZIGZAG ANTENNA

BACKGROUND AND FIELD OF THE INVENTION

The present invention relates to a circularly polarized zigzag antenna.

Zigzag antennas are known in the art, and are useful for broadcasting electromagnetic energy in the UHF frequency band. A conventional zigzag antenna generally takes the form of a solid or tubular conductor bent into a zigzag shape and disposed over a reflecting panel. Antennas of this type are disclosed in a number of United States patents including Woodward, U.S. Pat. No. 2,759,183; Fisk et al., U.S. Pat. Nos. 3,369,246 and 3,375,525; and Alford, U.S. Pat. No. 4,087,824. Although the antennas disclosed in these patents vary in certain structural aspects, they all share a common characteristic. In each case, the antenna will broadcast horizontally polarized electromagnetic energy.

The advantages of broadcasting or receiving circularly polarized signals, as opposed to horizontally polarized signals, has long been recognized. It has, for example, long been known that ghosting effects produced by reflections of the originally transmitted signal may be eliminated through use of circularly polarized signals.

A circularly polarized transmitting antenna for the UHF frequency band utilizing a zigzag antenna is disclosed in the IEEE Transactions on Broadcasting, Volume BC-24, No. 8, June, 1978, in an article by Andrew Alford. In this antenna, zigzag elements are again used for the conventional purpose of providing a horizontally polarized electromagnetic signal. Also used in conjunction with the zigzag elements, however, are other antenna elements whose purpose is to broadcast a vertically polarized signal in phase quadrature with the horizontal signal. The net effect is to provide a circularly polarized signal in the far field.

SUMMARY OF THE INVENTION

It is an object of the present invention to provide a circularly polarized transmitting antenna having a simpler construction than those previously known.

It is another object of the present invention to provide a circularly polarized transmitting antenna having a simplified feed arrangement.

It is yet another object of the present invention to provide a circularly polarized antenna which uses a zigzag element to broadcast both linearly polarized components of the circularly polarized electromagnetic energy.

Generally, the circularly polarized zigzag antenna to be described hereinafter is similar to a conventional zigzag antenna, except that the various linear segments of the bent conductor which forms the zigzag antenna are each one-quarter of a wavelength long, rather than one-half a wavelength as in the past, and further in that every other linear segment is joined to the next succeeding segment through a half wavelength delay line. To provide for center feeding, the antenna includes two longitudinally adjacent radiating elements with the adjacent ends of the elements being connected together through another half wavelength delay line.

Thus, in accordance with the present invention a rotating polarization zigzag antenna is provided comprising at least one conductive zigzag element, which in turn includes plural linear segments. These linear segments are each L/4 in length, where L is the mean operating wavelength of the antenna, and are disposed end-to-end with each segment being skewed in space to adjacent segments. Each segment is directly joined at one end to the adjacent end of an adjacent segment and indirectly joined at the other end to the adjacent end of the other adjacent segment through a substantially non-radiating L/2 length delay line. Each segment is thus skewed in space and orthogonal in phase to an adjacent segment, whereby said antenna is adapted to radiate or receive electromagnetic energy having a rotating polarization vector.

BRIEF DESCRIPTION OF THE DRAWINGS

The foregoing and other objects and advantages of the present invention will become more readily apparent from the following detailed description, as taken in conjunction with the accompanying drawings, wherein.

DETAILED DESCRIPTION

Figure 1:
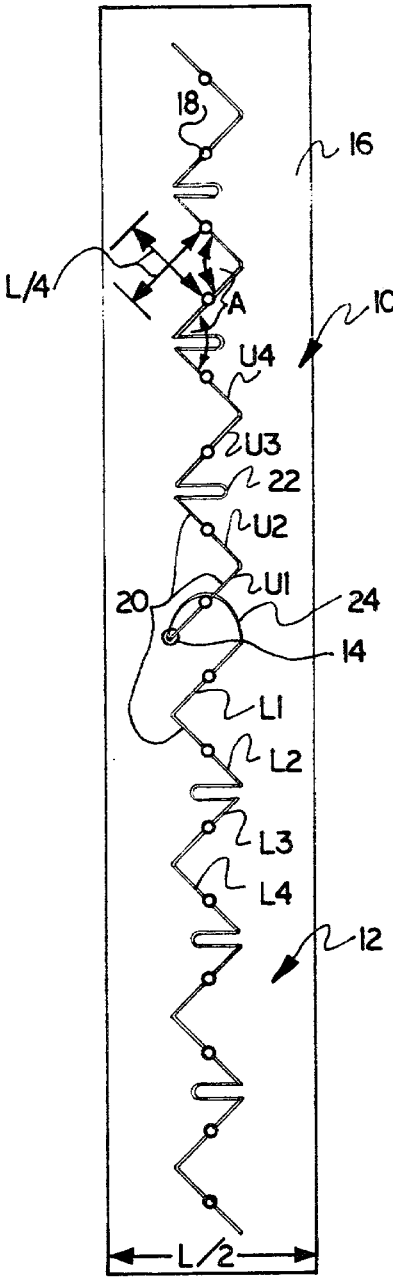
FIG. 1 is a plan view of a circularly polarized zigzag antenna in accordance with the teachings of the present invention.
Figure 2:
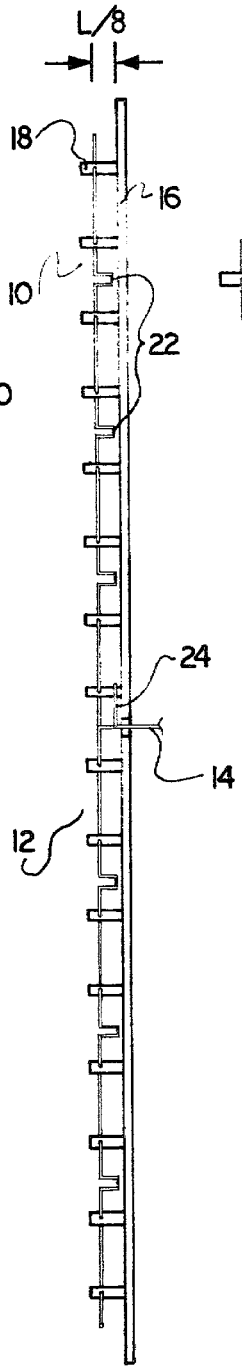
FIG. 2 is an elevational view of the antenna of FIG. 1.

FIGS. 1 and 2 are, respectively, plan and elevation views of a circularly polarized zigzag antenna in accordance with the teachings of the present invention. Although the antenna will generally be described as a transmitting antenna, it will of course be recognized that the antenna will have equal utility as a receiving antenna.

This antenna includes upper and lower radiating elements 10 and 12 formed of a good RF conductor, such as copperweld wire, and jointed at a common central feed point 14. These radiating elements 10 and 12 are disposed above a reflecting panel 16 by suitable insulating standoffs 18. The reflecting panel 16 may be of any conventional solid or mesh construction, preferably the latter to reduce the windload of the antenna. The size of this reflecting panel is not extremely critical. It will preferably be approximately L/2 in width, where L is the mean operating wavelength of the antenna, and somewhat greater in length than the radiating elements.

Each of the radiating elements 10 and 12 is composed of a plurality of preferably linear segments 20, each L/4 in length. Delay lengths 22 are interposed at every other junction between the various segments 20. In the illustrated embodiment the elements 20 all lie within a common, flat plane running generally parallel to the reflecting panel 16, and separated by approximately L/8 therefrom by the insulating standoffs 18. The number of segments in the upper and lower radiators will be selected in accordance with the desired gain of the antenna.

Each of the segments 20 is skewed at an angle (A) to adjacent segments. In the illustrated embodiment, the angle is 90° so that the antenna is equally sensitive to any two orthogonal linear polarizations; the antenna is then circularly polarized. Increasing or diminishing this angle (A) will sensitize the antenna to a particular linear polarization, making it elliptically polarized.

In order to understand the operation of this antenna, consider first the segments U1 and U2 of the top radiating element 10, closest to the feedpoint 14. The element U1 will radiate an electromagnetic signal which is orthogonal in space to the electromagnetic signal radiated by element U2 due to the orthogonal orientation of these two segments. Moreover, the two electromagnetic signals radiated by elements U1 and U2 will also be orthogonal in phase, since the element U1 essentially delays the feeding of element U2 by 90° due to its L/4 length. Thus, elements U1 and U2 will broadcast signals which are orthogonal in both space and phase to one another. The resulting composite signal will therefore be circularly polarized. Similarly, the next two elements U3 and U4 will broadcast a circularly polarized signal, as will each other pair of directly joined orthogonal segments.

The necessity for delay lengths 22 arises from the fact that the corresponding portions of elements U1 and U3 would be phase displaced by precisely 180°, were not the delay line 22 included. Consequently, the signal broadcast by elements U1 and U2 would be 180° out of phase with the signal broadcast by elements U3 and U4. This would suppress radiation, and no broadside beam would result. By including the L/2 delay lengths 22 between each pair of segments, any location along a segment pair will be phase displaced by precisely one wavelength from the corresponding location along each adjacent pair. Consequently, the signal broadcast thereby are in phase synchronism with one another and reinforce, rather than cancel, one another so that a broadside beam results. In order to maintain a close spatial orientation between each pair of segments, the delay lengths 22 have a folded configuration. The adjacent ends of the segments joined by the delay lengths are thus proximal one another. Moreover, the delay lengths 22 are bent back from the plane of the radiating elements 22 and instead run closely adjacent the reflecting panel 16, thereby suppressing any radiation thereby.

In order to maintain the proper phase relationship between the signals broadcast by the upper and lower radiating elements 10 and 12, the lower radiating element 12 is joined to the feed point 14 by means of another L/2 delay line 24 and the first segment L1 of the lower radiating element 12 runs parallel to the first element U1 of the upper radiating element 10. The delay line 24 is routed immediately adjacent the reflecting panel 16, again to suppress any radiation therefrom. Alternatively, an L/2 hybrid could be used to feed the upper and lower radiators. When configured in this manner, various locations along element L1 are phase displaced by 360°, or one wavelength from corresponding locations along element U1. Thus the desired phase synchronism in radiated signals results.

To feed the antenna, the feed point 14 is connected to the center conductor of a coaxial feed line, whereas the outer conductor of the feed line is connected to the electrically conductive reflector panel 16.

As illustrated, the antenna will broadcast right-hand circularly polarized electromagnetic energy. The antenna may also be designed to broadcast left-hand circularly polarized electromagnetic energy by simply changing the initial direction of each radiator. Thus, as viewed in FIG. 1 the elements U1 and L1 would point towards the upper left, rather than the upper right as illustrated.

Figure 3:
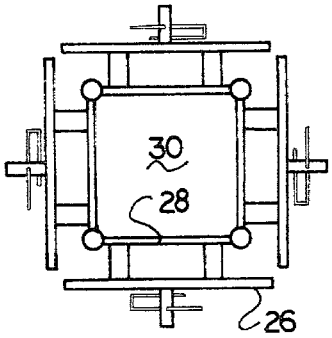
FIG. 3 is a cross sectional view of a square tower having an antenna as shown in FIGS. 1 and 2 mounted on each face thereof.

If desired, a number of antennas such as illustrated in FIGS. 1 and 2 may be connected to a common tower structure and fed through an appropriate power divider network. Thus, as illustrated in FIG. 3, one antenna 26 may be connected to each of the faces 28 of a tower 30 having a square cross section. If the four antennas of this bay are equally fed with power, then an omni-directional pattern will result. Of course, unequal power division to the panels within a bay may be used for directional patterns. Moreover, bays may be stacked, as conventionally, to obtain more directional vertical patterns. The feeding to the various bays can then be adjusted in a conventional manner for beam tilt and null fill. Deicing of the antenna may also be accomplished by known methods.

A zigzag antenna has therefore been described which is configured so that circularly polarized electromagnetic energy is broadcast thereby. Auxiliary antenna elements for broadcasting one of the two components of the circularly polarized signal are unnecessary since the zigzag antenna, by itself, generates both the horizontal and vertical components of the circularly polarized signal. This simplified the feed structure to the antenna, since now only a single antenna need be fed, rather than two or more. Furthermore, the antenna may be connected in one or more bays of antennas, as in the past, to achieve higher gain, directionality, etc.

Although the invention has been described with respect to a preferred embodiment, it will be appreciated that many alternatives of the specific described embodiment will also fall within the spirit and scope of the invention, as defined in the appended claims.

What is claimed is:

1. A rotating polarization zigzag antenna comprising at least one conductive zigzag element comprised of plural segments, each L/4 in length were L is the means operating wavelength of the antenna, disposed end to end in a zigzag configuration, each directly joined at one end to the adjacent end of an adjacent segment and indirectly joined at the other end to the adjacent end of the other adjacent segment through a substantially non-radiating L/2 length delay line, whereby each said segment is skewed in space and orthogonal in phase to an adjacent segment, said antenna thereby being adapted to radiate or receive rotating polarization electromagnetic energy.

2. An antenna as set forth in claim 1, wherein said L/2 length delay line comprises an L/2 length conductor folded so that the ends thereof are proximal one another, with each end of said delay line being joined to a corresponding end of an adjacent segment.

3. An antenna as set forth in claim 1, and further comprising reflecting means disposed in spaced relation from said at least one zigzag element to direct said radiated or received energy.

4. An antenna as set forth in claim 3, wherein said reflecting means is substantially planer and wherein said segments of said element all lie within a common plane running parallel to said surface.

5. An antenna as set forth in claim 4, wherein said delay line is routed closely adjacent said reflective means.

6. An antenna as set forth in claim 1, further comprising means for feeding said at least one zigzag element with electromagnetic energy to cause said element to radiate said energy, said radiated energy having a rotating polarization due to the configuration of said at least one element.

7. A rotating polarization zigzag antenna comprising an electrically conductive surface, first and second conductive zigzag elements disposed end to end above said surface, each element being comprised of plural linear segments disposed in a zigzag configuration, said segments each being skewed in space to adjacent segments and L/4 in length where L is the mean operating wavelength of the antenna, with alternate junctions between said segments being joined by L/2 nonradiating delay lines and the remaining segments being directly joined, and means for feeding electromagnetic energy to said first and second elements at the adjacent ends thereof, said feeding means including means for phasing the energy feed to said elements so that the signals broadcast by said first and second elements are substantially in phase synchronism with one another.

8. An antenna as set forth in claim 1 or 7 wherein each said segment is orthogonal in space to adjacent segments.

9. An antenna as set forth in claim 7, wherein the segment at said adjacent end of said first element is substantially parallel to the segment at said adjacent end of said second element, and wherein said adjacent ends are joined through a substantially nonradiating L/2 length delay line.

10. A rotating polarization zigzag antenna comprising:

(a) at least one zigzag radiating element comprised of plural linear segments, said segments being
  (I) each L/4 in length where L is the mean operating wavelength of the antenna,
  (II) disposed end to end, with each segment being orthogonal in space to adjacent segments,
  (III) each directly joined at one end to the adjacent end of an adjacent segment, and indirectly joined at the other end to the adjacent end of the other adjacent segment through a substantially nonradiating L/2 length delay line;
  whereby each said segment is orthogonal in space and phase to an adjacent segment; and (b) means for feeding said at least one radiating element with electromagnetic energy to cause said element to radiate said energy, said radiated energy having a rotating polarization vector due to the configuration of said at least one radiating element.

* * * * *